US005690608A

United States Patent [19]

Watanabe et al.

[11] Patent Number: 5,690,608

[45] Date of Patent: Nov. 25, 1997

[54] ULTRASONIC APPARATUS FOR HEALTH AND BEAUTY

[75] Inventors: Tsutomu Watanabe; Takashi Hamaura; Masao Utsumi, all of Tokyo, Japan

[73] Assignee: Asec Co., Ltd., Tokyo, Japan

[21] Appl. No.: 360,177

[22] Filed: Dec. 20, 1994

Related U.S. Application Data

[63] Continuation of Ser. No. 101,906, Aug. 4, 1993, abandoned.

[30] Foreign Application Priority Data

Apr. 8, 1992 [JP] Japan ..... 4-114239

[51] Int. Cl.[6] ..... A61H 1/00

[52] U.S. Cl. ..... 601/19; 601/2

[58] Field of Search ..... 601/2, 20, 15, 601/18, 19, 47; 128/24 AA, 24 R, 24.1, 24.2, 24.3, 36, 57, 67

[56] References Cited

U.S. PATENT DOCUMENTS

| | | | |
|---|---|---|---|
| 2,183,726 | 12/1939 | Sommer et al. | 128/24.3 |
| 3,828,769 | 8/1974 | Mettler | 128/24.2 |
| 4,082,089 | 4/1978 | Moriyama et al. | 128/24.3 |
| 4,175,551 | 11/1979 | D'Haenens et al. | 601/15 |
| 4,823,042 | 4/1989 | Coffey et al. | 310/322 |
| 4,873,966 | 10/1989 | Gitter . | |
| 4,944,302 | 7/1990 | Hernandez et al. | 601/15 |
| 5,123,406 | 6/1992 | Masuda | 128/57 |
| 5,176,130 | 1/1993 | Kim | 601/15 |

FOREIGN PATENT DOCUMENTS

| | | | |
|---|---|---|---|
| 0116113 | 8/1984 | European Pat. Off. . | |
| 3241094 | 5/1984 | Germany . | |
| 1195867 | 8/1989 | Japan | 128/57 |
| 2-15131 | 1/1990 | Japan . | |
| 123559 | 5/1991 | Japan . | |
| 3123559 | 5/1991 | Japan . | |

*Primary Examiner*—Jessica Harrison
*Assistant Examiner*—Michael O'Neill
*Attorney, Agent, or Firm*—Ostrolenk, Faber, Gerb & Soffen, LLP

[57] ABSTRACT

An ultrasonic apparatus for health and beauty includes a main body having a grip portion, a hollow cylindrical roller supported rotatably at one end of the main body, and an ultrasonic generating unit disposed in the hollow cylindrical roller, wherein the hollow cylindrical roller itself constitutes an ultrasonic vibrator which is excited by the ultrasonic vibrating unit. The apparatus may be further provided with a heat source, such as an incandescent lamp, accommodated in the hollow cylindrical roller for heating the roller, a temperature sensor disposed on the hollow cylindrical sensor or in a vicinity thereof, and a control unit for maintaining the hollow cylindrical roller at a predetermined temperature on the basis of an output signal from the temperature sensor.

18 Claims, 8 Drawing Sheets

ULTRASONIC APPARATUS FOR HEALTH AND BEAUTY

This application is a continuation of Ser. No. 08/101,906, filed Aug. 4, 1993, which is now abandoned.

BACKGROUND OF THE INVENTION

1. Field of the Invention

The present invention relates to an ultrasonic apparatus for health and beauty.

2. Description of the Related Art

It is already known that ultrasonic waves are effective for health and beauty. A known apparatus for health and beauty which employs ultrasonic waves is disclosed in, for instance, Japanese Patent Unexamined Publication No. 123559/1991. In this known apparatus, a disk-like vibration-transmitting plate for being brought into contact with the skin is provided at a distal end of a case which can be gripped by one hand, and an ultrasonic vibrator is attached to a rear surface of the vibration-transmitting plate. When the apparatus is used, the vibration-transmitting plate is stationarily brought into contact with the skin, and electric power is supplied to the ultrasonic vibrator in accordance with a predetermined program to excite the vibration-transmitting plate.

In addition, beauty rollers which make use of a massaging effect derived from being brought into contact with the skin and being rolled thereon is disclosed in, for example, Japanese Utility Model Unexamined Publication No. 15131/1990 and the like. Such a beauty roller is designed to obtain a synergistic effect which is derived from a massaging effect based on the rolling of the roller and a massaging effect based on the vibration of the roller by mechanically imparting vibrations to the roller.

However, with the apparatus of above-described Japanese Patent Unexamined Publication No. 123559/1991, it is possible to obtain merely the effect based on ultrasonic waves, and a synergistic effect incorporating the effect of another method cannot be expected. That is, with these references the benefit of repeatedly exerting force against the skin and underlying muscle tissue and releasing such force cannot be obtained. On the other hand, with the apparatus of Japanese Utility Model Unexamined Publication No. 15131/1990, a vibration generating device having a vibration motor is disposed in a grip portion for supporting a roller, and the mechanical vibration of the grip portion is transmitted to the roller through a roller bearing portion. This bearing portion constitutes a point of disconnection in the transmission of vibrations, and the loss in the transmission of vibrational energy is large. In addition, it is said that there are cases where the massaging effect based on such mechanical vibrations presents a problem in terms of the beauty culture of the facial skin.

SUMMARY OF THE INVENTION

The present invention has been devised in view of the above-described circumstances, and it is an object of the present invention to provide an ultrasonic apparatus for health and beauty which makes it possible to obtain the synergistic effect derived from a micro-massaging effect based on ultrasonic vibrations and a massaging effect based on the rolling of a roller.

To this end, in accordance with the present invention, there is provided an ultrasonic apparatus for health and beauty, comprising: a main body having a grip portion; a hollow cylindrical roller supported rotatably at one end of the main body; and an ultrasonic generating unit disposed in the hollow cylindrical roller, wherein the hollow cylindrical roller itself constitutes an ultrasonic vibrator which is excited by the ultrasonic vibrating unit.

In addition to the above-described arrangement, the hollow cylindrical roller may be formed of a material which radiates far-infrared rays. In this case, the thermal effect of far-infrared rays can be exhibited in a synergistic manner. As such a far-infrared radiant material, one having a high emissivity is preferable, and it is possible to cite a resin such as a cellulose acetate resin.

The apparatus of the present invention having the above-described construction is used by bringing the hollow cylindrical roller into contact with the skin and rolling the same.

First, if a supply switch (not shown) is turned on and high-frequency power is supplied, the hollow cylindrical roller itself acts as an ultrasonic vibrator and imparts ultrasonic vibrations to the skin. In addition, in a state in which a mechanical massage is being imparted to the skin by causing the hollow cylindrical roller to roll on the skin, a micro-massaging effect produced by the ultrasonic vibrations is added, thereby making it possible to obtain a synergistic effect. The ultrasonic energy penetrates not only the tissues of the skin but also the deep interior of the body, and acts on and further activates various cells of the skin, nerves, lymphatic vessels, blood vessels, and muscle layers, thereby promoting metabolism and improving the massaging effect.

Furthermore, in a case where the hollow-cylindrical roller is formed of a material which radiates far-infrared rays, a thermal effect is added to the above-described effects, thereby further promoting the activation of the cells.

The above and other objects, features and advantages of the present invention will become more apparent from the following detailed description of the invention when read in conjunction with the accompanying drawings.

DESCRIPTION OF THE PREFERRED EMBODIMENTS

Referring now to the accompanying drawings, a description will be given of the embodiments of the present invention.

Figure 1:
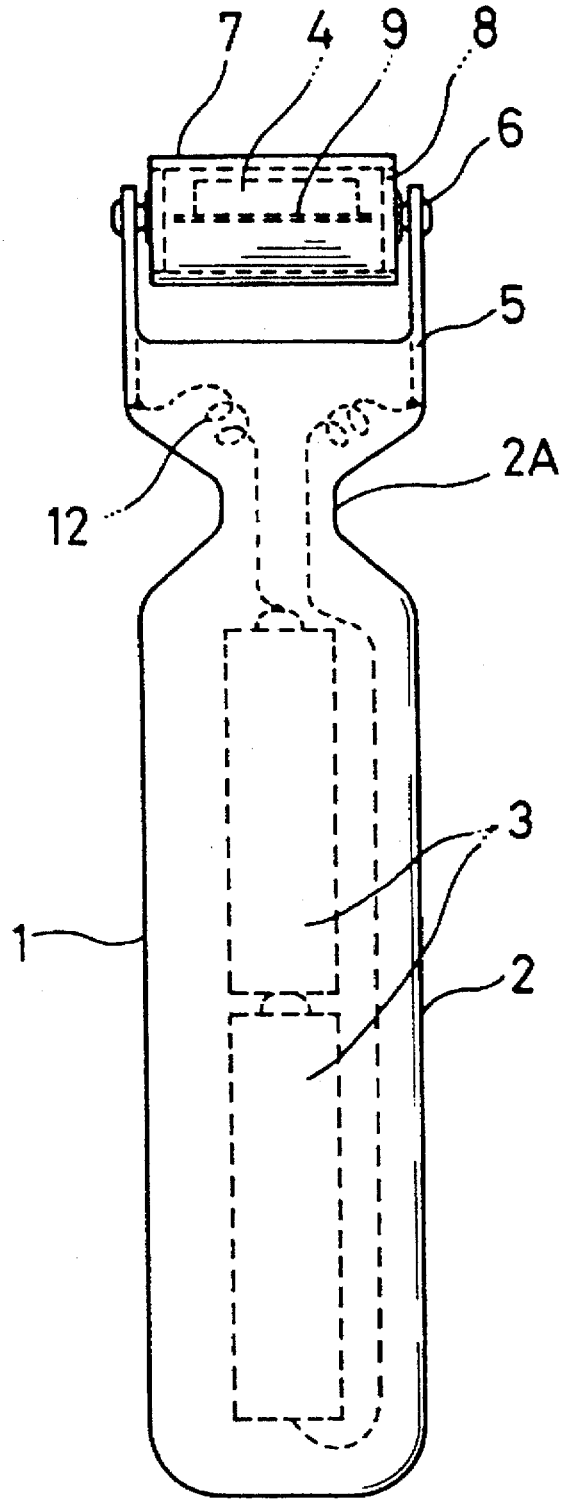
FIG. 1 is a front elevational view of an apparatus in accordance with a first embodiment of the present invention.
Figure 2:
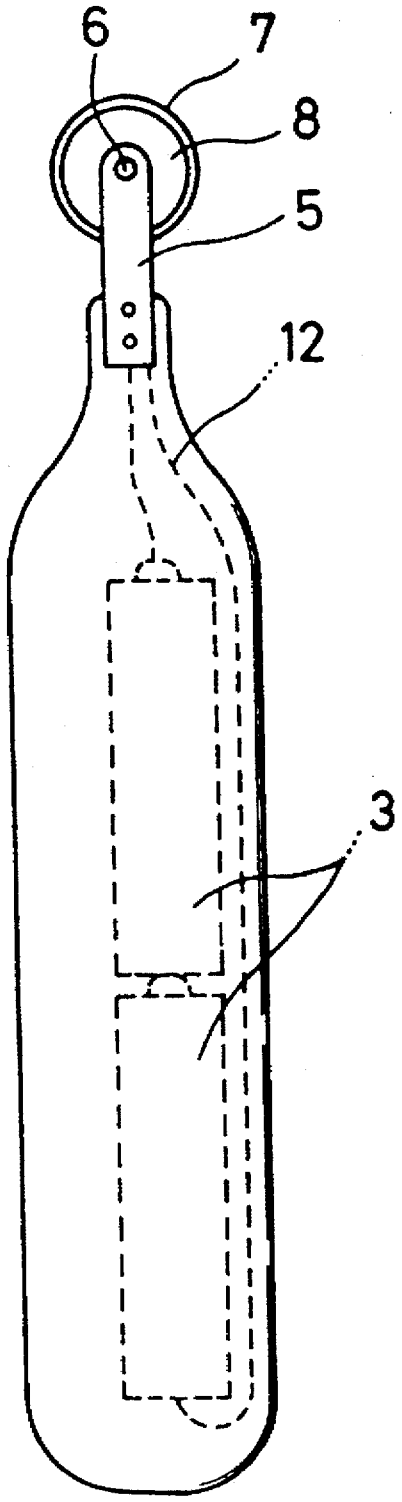
FIG. 2 is a side elevational view of the apparatus shown in FIG. 1.
Figure 3:
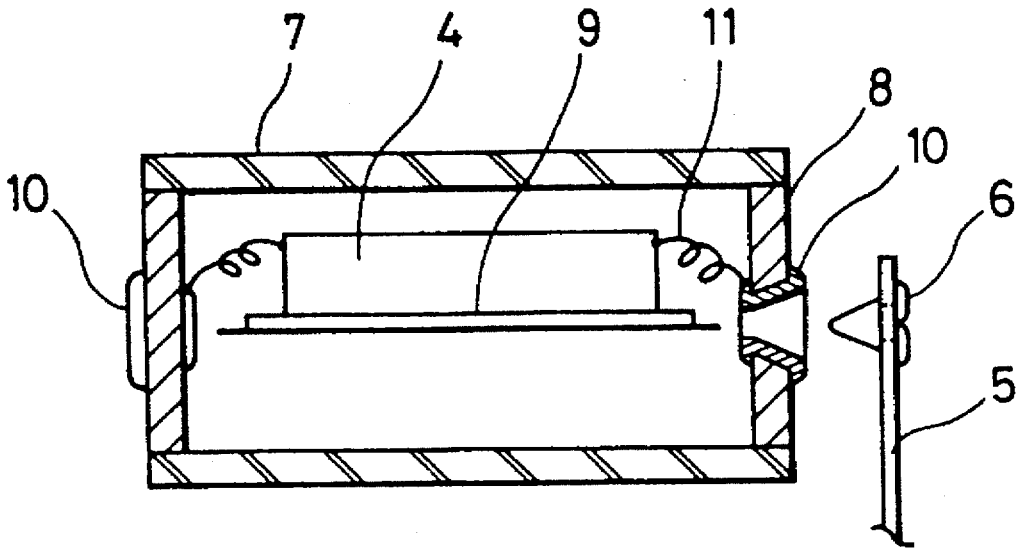
FIG. 3 is an enlarged cross-sectional view, taken along a plane including an axis, of a roller and its interior shown in FIG. 1.
Figure 4:
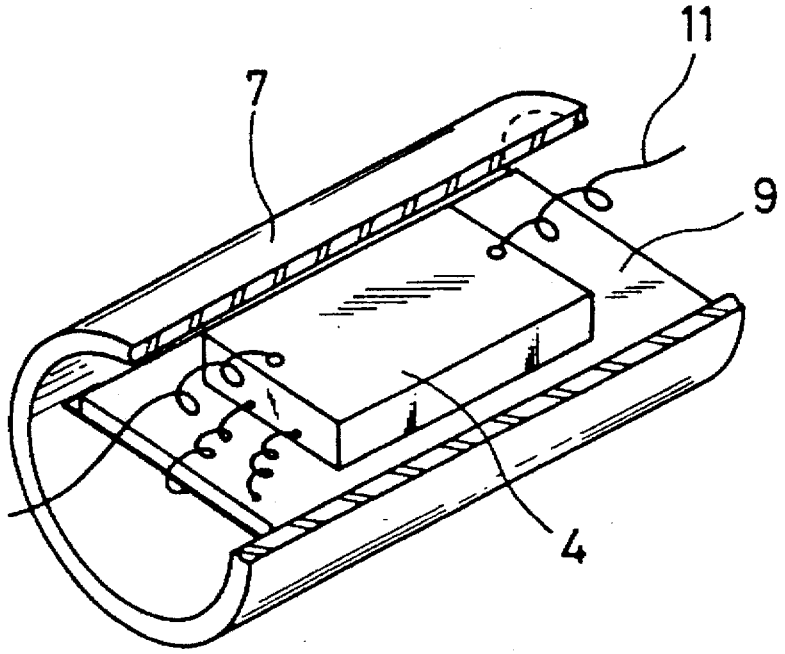
FIG. 4 is a partially cutaway perspective view of the roller of the apparatus shown in FIG. 1.
Figure 5:
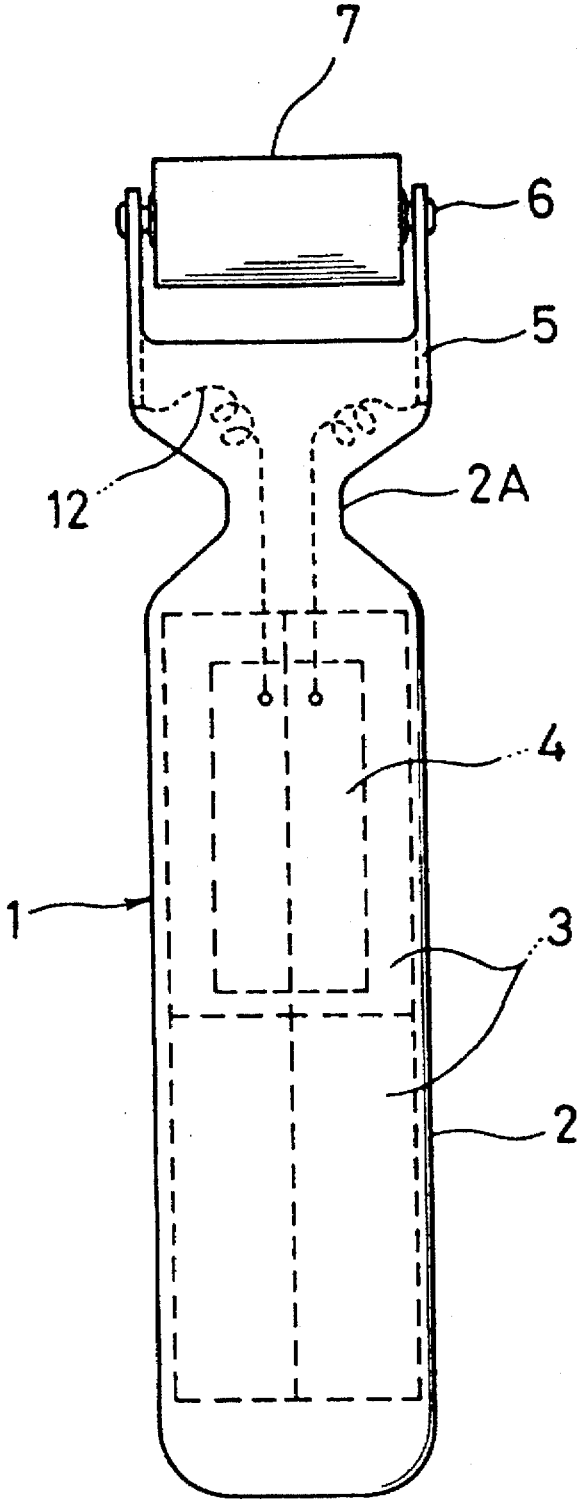
FIG. 5 is a front elevational view of an apparatus in accordance with a second embodiment of the present invention.
Figure 6:
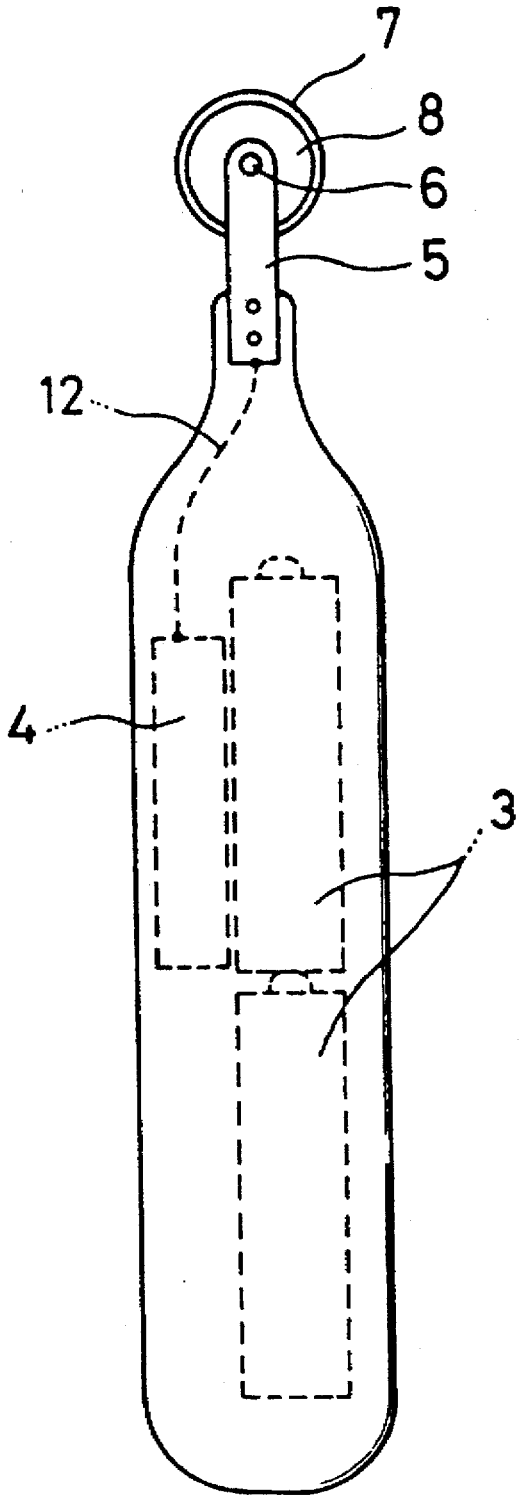
FIG. 6 is a side elevational view of the apparatus shown in FIG. 5.
Figure 7:
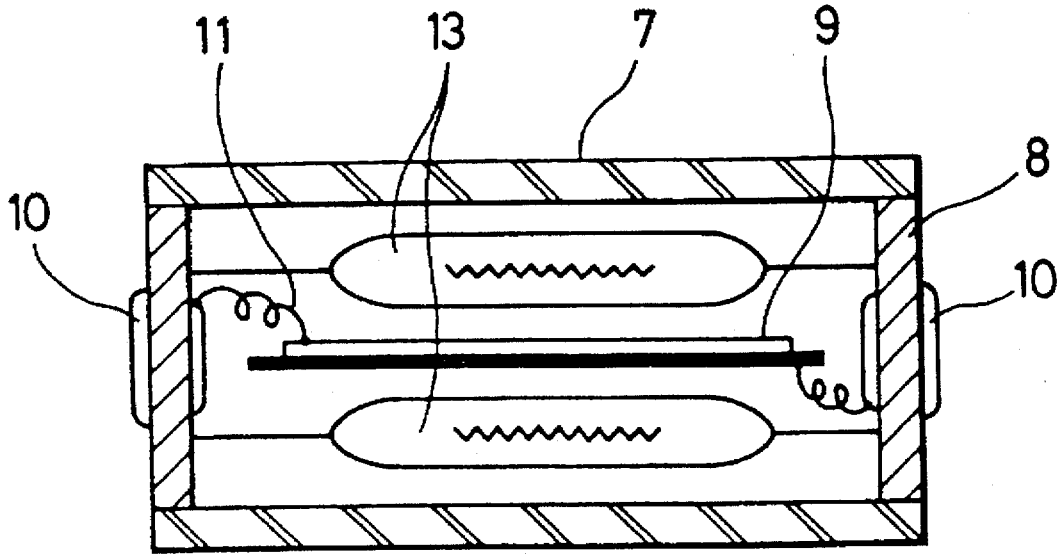
FIG. 7 is an enlarged cross-sectional view, taken along the plane including the axis, of the roller of the apparatus shown in FIG. 5.
Figure 8:
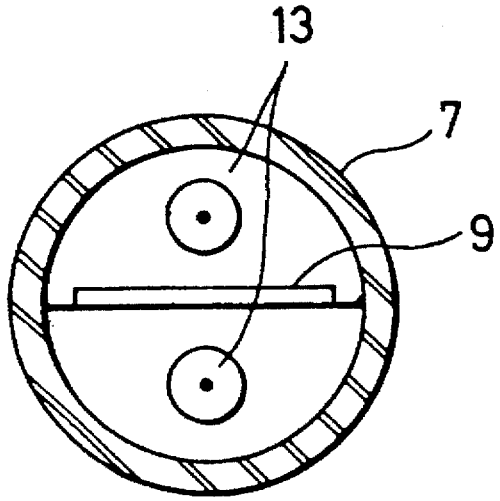
FIG. 8 is an enlarged cross-sectional view, taken along a plane perpendicular to the axis, of the roller of the apparatus shown in FIG. 5.

FIG. 1 is a front elevational view of an apparatus in accordance with a first embodiment of the present invention, and FIG. 2 is a side elevational view thereof. In addition, FIG. 3 is an enlarged cross-sectional view of a roller 7, and FIG. 4 is a cutaway perspective view of the roller 7. In the drawings, reference numeral 1 denotes a main body 1 having a grip portion 2 which can be gripped by one hand. The main body 1 has an internal space, in which a power source 3 such as batteries are incorporated.

A neck portion 2A having a constricted shape is formed in an upper end portion of the main body 1, and a pair of support arms 5 formed of a metal conductor are attached to an upper end of the main body 1 in such a manner as to extend therefrom. Conical projections 6 formed of a metal conductor and constituting shafts of pivot bearings are respectively provided on distal ends of the pair of support arms 5 on opposing surfaces thereof.

The roller 7 of a hollow cylindrical shape has a pair of covers 8 respectively fitted at both ends thereof. Each conical projection 6 of the support arm 5 is fitted in a conical recessed portion 10 formed of a metal conductor and formed as a seat of the pivot bearing on an outer surface of the cover 8, so as to constitute the pivot bearing. Hence, the roller 7 is rotatable about the pivot bearings.

As shown in FIG. 3, a high-frequency generating unit 4 and an ultrasonic generating unit 9 are accommodated in the above-described roller 7. The high-frequency generating unit 4 has a circuit for generating a high frequency as electric power from the power source 3 is supplied thereto. The ultrasonic generating unit 9 is formed of a plate-like vibrator such as a piezoelectric ceramic, and the vibrator 9, which is the ultrasonic generating unit, is secured at its sides to an inner surface of the above-described roller 7. The high-frequency generating unit 4 is connected to the power source 3 via leads 11, the pivot bearings 10, 6, the support arms 5, and leads 12.

Such an apparatus in accordance with the present embodiment is used as the user, while holding the main body 1 in his or her hand, rolls the roller 7 in contact with the skin.

The vibrator 9 is driven by receiving high-frequency electric power from the high-frequency generating unit 4. The ultrasonic vibrations of the vibrator 9 are transmitted to the roller 7, and ultrasonic vibrations are produced from the roller 7.

If the ultrasonic vibrations are imparted to the skin while the roller 7 is thus being rolled, the mechanical massaging effect based on rolling and the micro-massaging effect based on the ultrasonic vibrations coact in a synergistic manner, and the effect is improved by a remarkable degree.

In the apparatus of the present embodiment, the vibrator 9 does not need to have the shape of a rectangular plate as illustrated. For instance, the vibrator 9 may be formed in the shape of a disk, and its outer peripheral surface may be bonded to the inner surface of the roller 7, or a sheet material known as a piezoelectric plastic may be attached to the inner surface of the roller 7.

Next, a description will be given of the apparatus in accordance with a second embodiment of the present invention.

The present embodiment is characterized in that the roller is so arranged as to radiate far-infrared rays, and the thermal effect of far-infrared rays can be exhibited in a synergistic manner in addition to the effects based on the rolling of the roller and the ultrasonic vibrations in the foregoing embodiment.

In FIGS. 5, 6, 7 and 8, the roller 7 of a hollow cylindrical shape is formed of a high-polymer resin having a high emissivity of far-infrared radiation, such as a cellulose acetate resin. In addition to the vibrator 9 similar to that of the foregoing embodiment, an incandescent lamp 13 (two incandescent lamps are used in the illustrated example) serving as a heat source for heating is provided in the above-described roller 7. It should be noted that, in the present embodiment, the high-frequency generating unit 4 is accommodated in the main body 1. The incandescent lamp 13 is used to heat the aforementioned roller 7 and increase the far-infrared radiant energy of the roller 7. As for the power source of the incandescent lamp 13, the high-frequency generating unit 4 in the body 1, which is used for the ultrasonic generating unit 9, is connected to the incandescent lamp 13 in parallel with the ultrasonic generating unit 9, and the high-frequency generating unit 4 is thus used to serve as a power source for the incandescent lamp.

In addition, the roller 7 may be provided with hazing and/or coloring treatment to bring about a tastewise or psychological effect at the time of use.

Next, a description will be given of the apparatus in accordance with a third embodiment of the present invention.

The present embodiment is characterized in that the temperature of the roller in the second embodiment is maintained to a desired level to make it possible to meet the users various demands.

Figure 9:
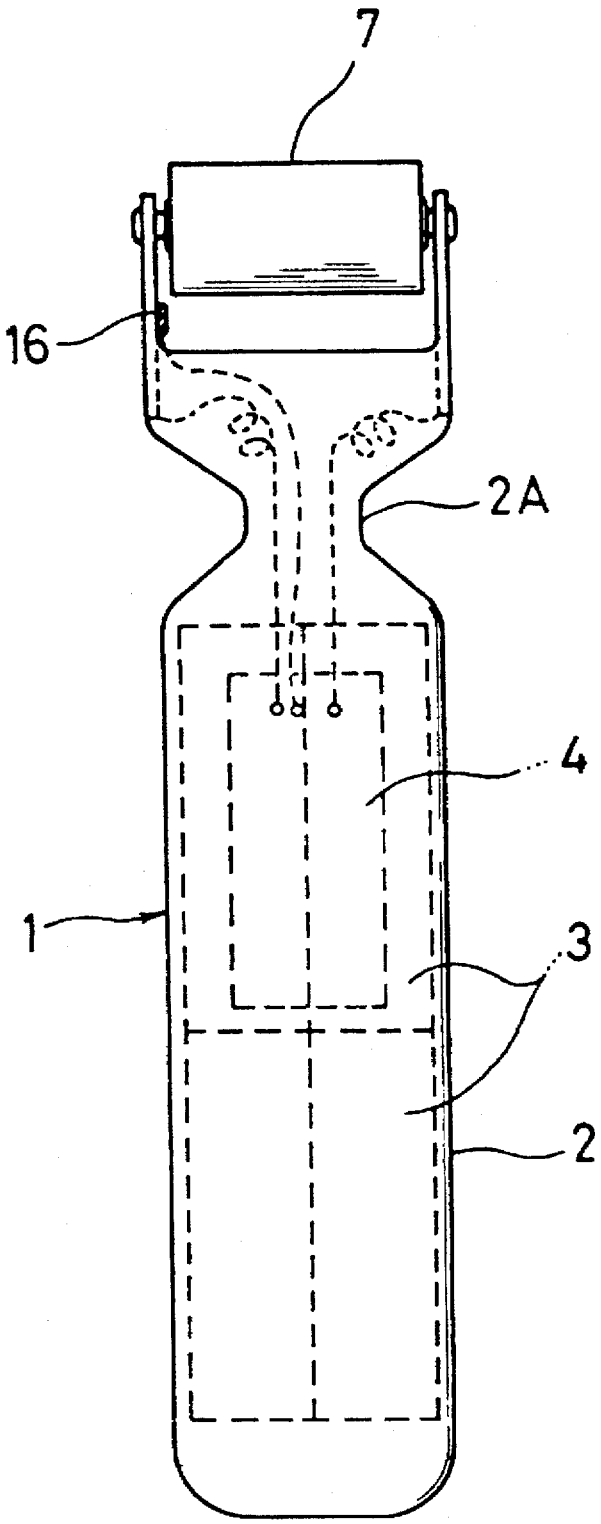
FIG. 9 is a front elevational view of an apparatus in accordance with a third embodiment.
Figure 10:
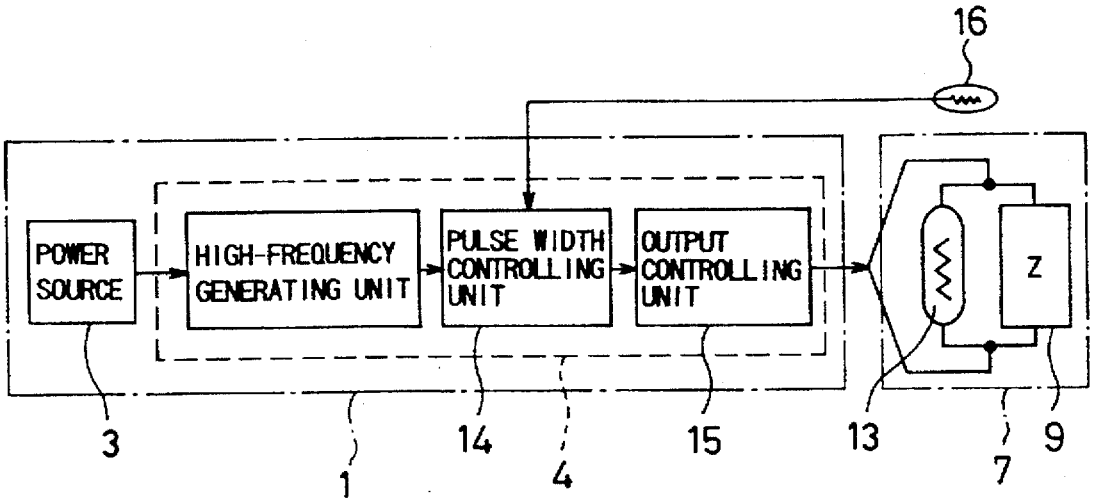
FIG. 10 is a block diagram of the apparatus shown in FIG. 9.

In the apparatus of the present embodiment, as shown in FIGS. 9 and 10, a pulse width controlling unit 14 and an output controlling unit 15 are disposed between the high-frequency generating unit 4 on the one hand, and the ultrasonic generating unit 9 and the incandescent lamp 13 on the other. The pulse width of the generated high frequency is controlled on the basis of a signal from a temperature sensor 16 disposed on the roller 7 or in the vicinity thereof, so as to control the effective electric power supplied to the heat source, thereby allowing an optimum roller temperature to be obtained for the user and a body part to which the apparatus is applied.

As described above, in accordance with the ultrasonic apparatus for health and beauty of the present invention, a massaging effect is obtained by imparting stimuli to skin cells by applying the roller to the skin and rolling it on the skin. At the same time, since the ultrasonic generating unit is incorporated in the roller, and the roller itself functions as an ultrasonic vibrator by supplying high-frequency electric power to the ultrasonic generating unit, the micro-massaging effect can also be exhibited in a synergistic manner. Furthermore, in the case where the roller itself is formed of a material which radiates far-infrared rays, the effect of far-infrared radiation can also be obtained. Moreover, all the various functions are condensed in the hollow cylindrical roller, and the circuit system is very simple, so that the structure can be made very compact as a hand-held type or a portable type. The apparatus can be manufactured by using only those materials which are inexpensive and readily available, and the apparatus is lightweight and simple to use.

What is claimed is:

1. In an ultrasonic apparatus for health and beauty treatments which includes a main body having a grip portion, a power source contained in an inner space of said main body, and a hollow roller supported rotatably at one end of said main body by bearings;

the improvement comprising an ultrasonic generating unit disposed in said hollow roller, a high-frequency generating unit electrically connected to said power source and to said ultrasonic generating unit, said ultrasonic generating unit generating ultrasonic vibrations when energized by said high-frequency generating unit, said bearings being conductive and coupling energy from said power source within said inner space to said ultrasonic generating unit within said hollow roller, said ultrasonic generating unit directly engaging said hollow roller so as to efficiently transfer when energized vibrations therefrom to said hollow roller so that said hollow roller itself constitutes an ultrasonic vibrator which is excited by said ultrasonic generating unit, said hollow roller while being rolled on human skin producing a massage effect on the skin from rolling and from ultrasonic vibrations transferred from said ultrasonic generating unit to said hollow roller.

2. An ultrasonic apparatus for health and beauty treatments according to claim 1, wherein said hollow roller is formed of a material which radiates far-infrared rays.

3. An ultrasonic apparatus for health and beauty treatments according to claim 2, wherein said hollow roller is formed of a high-polymer resin material which radiates far-infrared rays at ordinary temperature.

4. An ultrasonic apparatus for health and beauty treatments according to claim 2, further comprising: a heat source accommodated in said hollow roller for heating said hollow cylindrical roller.

5. An ultrasonic apparatus for health and beauty treatments according to claim 4, wherein a high-frequency generating unit for said ultrasonic generating unit is connected to said heat source in parallel with its connection to said ultrasonic generating unit.

6. An ultrasonic apparatus for health and beauty treatments according to claim 4 or 5, further comprising:

a temperature sensor disposed adjacent said hollow roller; and a control unit for maintaining said hollow cylindrical roller at a predetermined temperature on the basis of an output signal from said temperature sensor.

7. An ultrasonic apparatus for health and beauty treatments according to claim 6, wherein said control unit controls the temperature of said hollow roller while maintaining a predetermined output from said ultrasonic generating unit.

8. An ultrasonic apparatus for health and beauty treatments according to claim 4, wherein said heat source is constituted by an incandescent lamp, and at least one of hazing means and coloring means is provided in a vicinity of said incandescent lamp inside said hollow roller.

9. An ultrasonic apparatus for health and beauty treatments according to claim 1 comprising leads extending within said hollow roller electrically connected to a part of said bearings which rotates with said hollow roller, and leads extending within said inner space of said main body electrically connected to a stationary part of said bearings, said leads coupling energy from said power source within said inner space to said ultrasonic generating unit within said hollow roller through said bearings.

10. An ultrasonic apparatus for health and beauty treatments according to claim 9 wherein said high frequency generating unit is disposed in said hollow space, said leads within said hollow roller couple energy from said high frequency generating unit to said bearings, and said leads within said hollow roller couple energy from said bearings to said ultrasonic generating unit.

11. An ultrasonic apparatus for health and beauty treatments according to claim 10 wherein said high frequency generating unit is disposed in said hollow roller, said leads within said hollow space couple energy from said power source to said bearings, and said leads within said hollow roller couple energy from said bearings to said high frequency generating unit.

12. In an ultrasonic apparatus for health and beauty treatments which includes a main body having a grip portion, a power source contained in an inner space of said main body, and a hollow roller supported rotatably at one end of said main body by bearings;

the improvement comprising an ultrasonic generating unit disposed in said hollow roller, said bearings being conductive and coupling energy from said power source within said inner space to said ultrasonic generating unit within said hollow roller, said ultrasonic generating unit directly engaging said hollow roller so as to efficiently transfer when energized vibrations therefrom to said hollow roller so that said hollow roller itself constitutes an ultrasonic vibrator which is excited by said ultrasonic generating unit, said hollow roller while being rolled on human skin producing a massage effect on the skin from rolling and from ultrasonic vibrations transferred from said ultrasonic generating unit to said hollow roller.

13. An ultrasonic apparatus for health and beauty treatments according to claim 7, wherein said control unit varies a generated pulse width of said high-frequency generating unit on the basis of that output signal from said temperature sensor so as to control effective electric power supplied to said heat source, thereby maintaining said hollow roller at the predetermined temperature.

14. An ultrasonic apparatus for health and beauty treatments according to claim 12, wherein said bearings mount said hollow roller on said main body so as to permit rotation of said roller.

15. An ultrasonic apparatus for health and beauty treatments according to claim 14, wherein a high frequency signal is transferred to said ultrasonic generating unit via said conductive bearings.

16. An ultrasonic apparatus for health and beauty treatments according to claim 14, further comprising a heat source accommodated in said hollow cylindrical roller for heating said hollow roller.

17. An ultrasonic apparatus for health and beauty treatments according to claim 16, wherein power is transferred to said heat source via said conductive bearings.

18. An ultrasonic apparatus for health and beauty treatments according to claim 12 comprising leads extending within said hollow roller electrically connected to a part of said bearings which rotates with said hollow roller, and leads extending within said inner space of said main body electrically connected to a stationary part of said bearings, said leads coupling energy from said power source within said inner space to said ultrasonic generating unit within said hollow roller through said bearings.

* * * * *